US005813653A

United States Patent [19]

Esch et al.

[11] Patent Number: 5,813,653

[45] Date of Patent: Sep. 29, 1998

[54] ELECTROMAGNETICALLY CONTROLLED REGULATOR

[75] Inventors: Thomas Esch; Martin Pischinger, both of Aachen; Michael Schebitz, Eschweiler, all of Germany

[73] Assignee: FEV Motorentechnik GmbH & Co. KG, Aachen, Germany

[21] Appl. No.: 696,979

[22] PCT Filed: Dec. 15, 1995

[86] PCT No.: PCT/EP95/04970

§ 371 Date: Nov. 4, 1996

§ 102(e) Date: Nov. 4, 1996

[87] PCT Pub. No.: WO96/19643

PCT Pub. Date: Jun. 27, 1996

[30] Foreign Application Priority Data

Dec. 21, 1994 [DE] Germany ..... 94 20 463 U

[51] Int. Cl.[6] ..... F16K 31/06

[52] U.S. Cl. ..... 251/129.1; 335/266

[58] Field of Search ..... 251/129.1, 129.15, 251/129.09; 123/90.11, 90.65; 335/266, 268, 269

[56] References Cited

U.S. PATENT DOCUMENTS

| | | | |
|---|---|---|---|
| 1,471,861 | 10/1923 | Perrault . | |
| 3,882,833 | 5/1975 | Longstaff et al. . | |
| 4,649,803 | 3/1987 | Abel | 251/129.1 X |
| 4,831,973 | 5/1989 | Richeson, Jr. . | |
| 4,841,923 | 6/1989 | Buchl | 251/129.1 X |
| 5,548,263 | 8/1996 | Bulgatz et al. | 251/129.1 X |

FOREIGN PATENT DOCUMENTS

| | | |
|---|---|---|
| 0043423 | 1/1982 | European Pat. Off. . |
| 0197357 | 10/1986 | European Pat. Off. . |
| 0405189 | 1/1991 | European Pat. Off. . |
| 2630512 | 1/1978 | Germany . |
| 4004876 | 9/1991 | Germany . |

*Primary Examiner*—Kevin Lee
*Attorney, Agent, or Firm*—Spencer & Frank

[57] ABSTRACT

An electromagnetic actuator operating a cylinder valve of an internal-combustion engine includes first and second spaced electromagnets having pole faces oriented toward one another; an armature arranged for reciprocating motion between the pole faces; and a connecting rod having a first rod part being in an abutting contact with a first side of the armature and being a component separate therefrom. The abutting contact is such as to prevent a torque transmission between the first rod part and the armature. The connecting rod has a second rod part which is rigidly affixed to a second side of the armature and extending towards the cylinder valve. There are further provided a first spring situated adjacent the first electromagnet externally thereof and arranged for urging the first rod part into the abutting contact with the armature for urging the armature away from the first pole face towards the second pole face; and a second spring situated adjacent the second electromagnet externally thereof and arranged for urging the armature away from the second pole face towards the first pole face. The first and second springs act oppositely such that in a de-energized state of the first and second electromagnets the armature is held by the first and second springs in an intermediate position between the pole faces of the first and second electromagnets.

7 Claims, 1 Drawing Sheet

ELECTROMAGNETICALLY CONTROLLED REGULATOR

BACKGROUND OF THE INVENTION

Electromagnetically controlled actuators, in particular those used to actuate cylinder valves in internal combustion engines, are well known, for example from EP-A-0 043 426 and EP-A-0 197 357. However, these known structures have a specific unit weight and require substantial space, so that they cannot be used as actuators for cylinder valves for internal combustion engines of a modern design, in particular those with multivalve operation.

SUMMARY OF THE INVENTION

It is an object of the invention to simplify the design of the already known electromagnetic actuators and thus achieve a more compact, space-saving structure.

This object and other to become apparent as the specification progresses, are accomplished by the invention, according to which, briefly stated, the electromagnetic actuator for operating a cylinder valve of an internal-combustion engine includes first and second spaced electromagnets having pole faces oriented toward one another; an armature arranged for reciprocating motion between the pole faces; and a connecting rod having a first rod part being in an abutting contact with a first side of the armature and being a component separate therefrom. The abutting contact is such as to prevent a torque transmission between the first rod part and the armature. The connecting rod has a second rod part which is rigidly affixed to a second side of the armature and extending towards the cylinder valve. There are further provided a first spring situated adjacent the first electromagnet externally thereof and arranged for urging the first rod part into the abutting contact with the armature for urging the armature away from the first pole face towards the second pole face; and a second spring situated adjacent the second electromagnet externally thereof and arranged for urging the armature away from the second pole face towards the first pole face. The first and second springs act oppositely such that in a de-energized state of the first and second electromagnets the armature is held by the first and second springs in an intermediate position between the pole faces of the first and second electromagnets.

It is advisable to provide that one spring element acts directly upon the armature and the other, oppositely working spring element acts upon the armature in the manner of a return spring via the setting element. This type of design makes it possible to effectively use the pole faces, which leads to a more compact shape for the actuator on the whole. It is another advantage of this configuration that if it is used, for example, as an actuator for a cylinder valve of an internal combustion engine, the cylinder valve, which constitutes the setting element, can be provided as before with a valve spring that is effective in the closing direction, and which simultaneously functions as one of the actuator spring elements that acts upon the armature of the actuator. For an embodiment of the invention, it is therefore advisable to have the spring elements arranged on the front of at least one of the electromagnets.

A particularly advantageous embodiment of the invention provides that the connecting rod is designed in parts, wherein one part is connected fixedly with the armature and the other part which faces away from the setting element, is connected to the coordinated spring element with a force transmitting connection to the armature. As a result of such a division of the connecting rod, the armature can perform a purely axial movement with the rigidly connected segment of the connecting rod, while the connecting rod segment connected to the spring element, for example when using a coil spring as spring element, can carry out the spring rotation that occurs during movement without influencing the armature. The connecting rod can be fixedly secured to the setting element.

An advantageous embodiment of the invention provides that the spring element facing the setting element is connected to an attachment on the setting element. The attachment is connected to the setting element such that force is transmitted via the spring to the connecting rod. If a coil spring is used as a second spring element, this, in turn, will result in an uncoupling of the armature with its connecting rod from the attachment on the setting element, so that the setting element can carry out the operationally occurring spring rotation without affecting the armature. A further advantage is that the second spring element can simultaneously act upon the setting element as a return spring by way of the attachment on the setting element.

One particularly advantageous embodiment provides that the two oppositely working spring elements are arranged on the side of the electromagnet that faces the setting element, wherein one spring element acts upon the connecting rod and the other spring element acts upon an attachment on the setting element and that the connecting rod and the attachment have a force-transmitting connection. This arrangement makes it possible to provide the two spring elements on one side of the electromagnet arrangement only, wherein it is also possible to reduce the structural height if one spring element is telescopically arranged around the other spring element.

A further advantageous embodiment of the invention provides that the magnetic coil for each electromagnet is connected to a laminated yoke element to reduce the development of eddy currents.

One particularly advantageous embodiment of the invention provides that one of the two electromagnets is arranged such that it can be moved in the movement direction of the armature and is connected to an adjusting device which can be used to change the distances between the facing pole faces for the two electromagnets. This makes it possible to change the distance between the pole faces of the two coordinated electromagnets and thus also the armature stroke and, accordingly, also the stroke for the setting element to be actuated. One suitable embodiment of the invention provides that an additional electromagnet constitutes the adjusting device, through which the movably arranged electromagnet, in cooperation with a spring element functioning as a return spring, can be maintained in two different end positions. With a corresponding arrangement, it is also possible to use one of the spring elements already existing at the setting device as a return spring.

DESCRIPTION OF THE PREFERRED EMBODIMENTS

Figure 1:
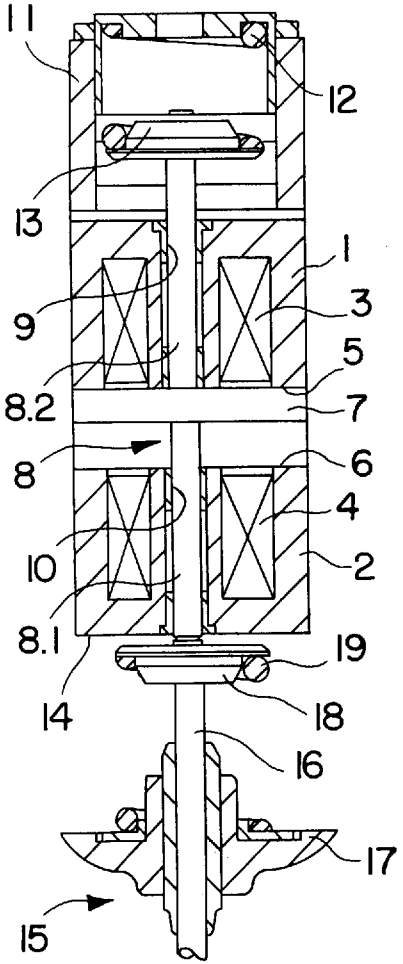
FIG. 1 is an axial sectional view of an actuator for a cylinder valve of an internal combustion engine.

The actuator for operating a cylinder valve, shown in FIG. 1, has two electromagnets 1 and 2, arranged at a distance from each other, the yoke element of which has magnetizing coils 3 and 4. The respective pole faces 5 and 6 are facing each other. An armature 7 is provided between the two pole faces 5 and 6 and is connected to a two-part connecting rod 8. One segment (part) 8.1 of the connecting rod is fixedly connected with the armature, while the other connecting rod segment (part) 8.2 rests on the armature 7.

The connecting rod 8 is respectively guided inside a borehole 9 of electromagnet 1 and a borehole 10 of electromagnet 2.

On its end facing away from armature 7, the electromagnet 1 is provided with a housing 11 that functions as a supporting surface for a spring 12, which is supported at its other end on a disk 13 that is affixed to the connecting rod 8.2.

The front surface 14 of the electromagnet 2, oriented away from the armature 7, faces a setting element 15, namely a cylinder valve of an internal combustion engine. The valve stem 16 of cylinder valve 15 is guided conventionally inside cylinder head 17. The free end of valve stem 16 is affixed to a spring seat disk (spring support) 18, which serves as a supporting surface for a spring element 19 which, at its other end is supported on the cylinder head 17. The spring element 19, like the spring element 12, is a coil spring designed for compression, so that the two spring elements are working against one another. The spring element 19 simultaneously serves as a closing spring for the cylinder valve.

The spring element 12 on the one side and the spring element 19 on the other side of the armature 7 are configured such that the balanced state for armature 7 is approximately in the middle between the two opposite pole faces 5 and 6 of electromagnets 1 and 2. One of the spring elements, for example the spring element 12, can have a progressive characteristic curve, so that the balanced state is displaced from the center position in the direction of the electromagnet 1, thus permitting an easier start-up.

If the power supply for the electromagnet 1 is turned on, then the armature 7 comes to rest against the pole face 5, in the course of which the spring element 12 is compressed and the spring element 19 is essentially relaxed. The cylinder valve is closed in this position.

The power supply for electromagnet 1 is turned off to open the cylinder valve, and the power supply for electromagnet 2 is turned on after a certain point in time. As a result, the armature 7 is no longer held against the pole face 5 of the electromagnet 1, so that the spring 12 can move the armature in the direction of the center position between the two pole faces 5 and 6 of magnets 1 and 2. During this occurrence the spring element 19 is stressed.

The system swings beyond the balanced state toward the other side. Since the power supply for electromagnet 2 has meanwhile been turned on, armature 7 is captured and comes to rest against the pole face 6. The spring element 12 is now partially relaxed, whereas the spring element 19 is compressed. Since the valve stem 16 is connected in each position force-transmittingly via spring element 19 to connecting rod 8, it is displaced by this amount, and the cylinder valve is opened accordingly. The operation is reversed in order to close the cylinder valve, so that the above-described process takes place in the reverse sequence.

Since the spring elements 12 and 19 are each arranged axially and face the electromagnets 1, 2, a very slender design results. In contrast to the previously known magnetic systems for which the spring elements are integrated into the magnetic body, this also results in a more effective use of the pole faces. The division of the connecting rod 8 into the connecting rod segment 8.2 that is connected to spring element 12 and the connecting rod segment 8.1 which is connected to the armature, on the one hand, and the uncoupling of connecting rod segment 8.1 from the setting element (the valve stem 16) to be actuated, that is connected to the spring seat disk 18, has the advantage that the rotation occurring during compressing and relaxing the spring elements 12 and 19 (which are preferably coil springs), remains confined to the component connected to the spring element. Stated differently, the torque derived from axial deformations of springs 12 and 19 is not transmitted to the armature 7.

Figure 2:
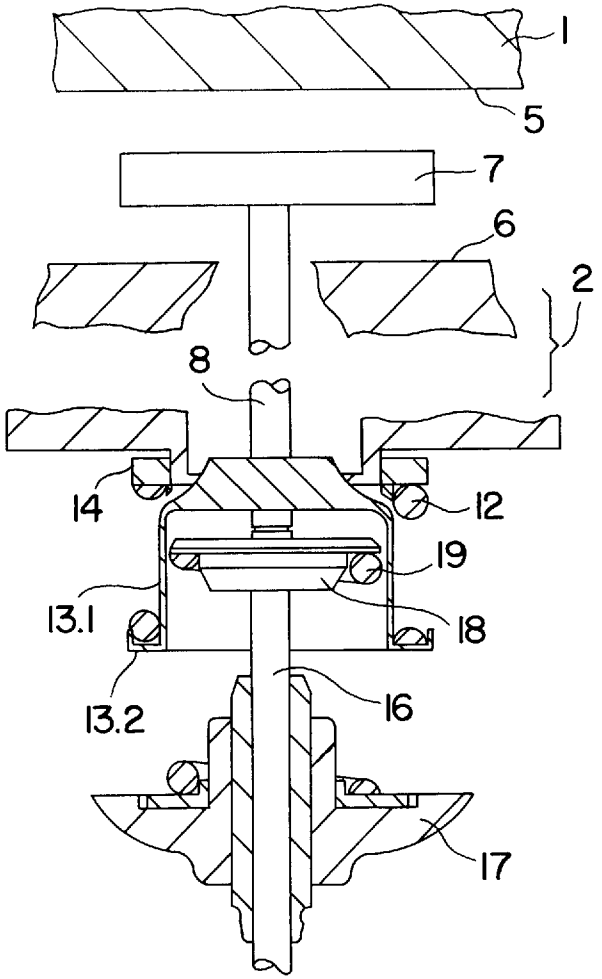
FIG. 2 is an exploded axial sectional view of a special spring combination.

FIG. 2 shows an embodiment where, starting with a magnet arrangement as described with the aid of FIG. 1, both spring elements 12 and 19 are arranged on the end face of the lower magnet 2, which is oriented toward the setting member 15. Armature 7 is provided via its connecting rod 8 with a bell-shaped countersupporting element 13.1. The spring element 12 is supported with one end on the free edge 13.2 of the countersupporting element 13.1 and with the other end on the front surface 14 of magnet 2. The spring support 18 connected to valve stem 16 is located on the inside of the element 13.1 and is thereby supported via the spring element 19 on the surface of cylinder head 17, as described in FIG. 1. Due to such nesting of the spring element 19 in the spring element 12, a reduction of the structural height is possible as compared to the embodiment according to FIG. 1, without having to relinquish the compact design for the electromagnets. The operational mode corresponds to that described with the aid of FIG. 1. The two spring elements 12 and 19 have the same spring rigidity, despite the different geometric dimensions. In order to facilitate the "start-up," spring element 12 can have a progressive characteristic curve, as described above.

Figure 3:
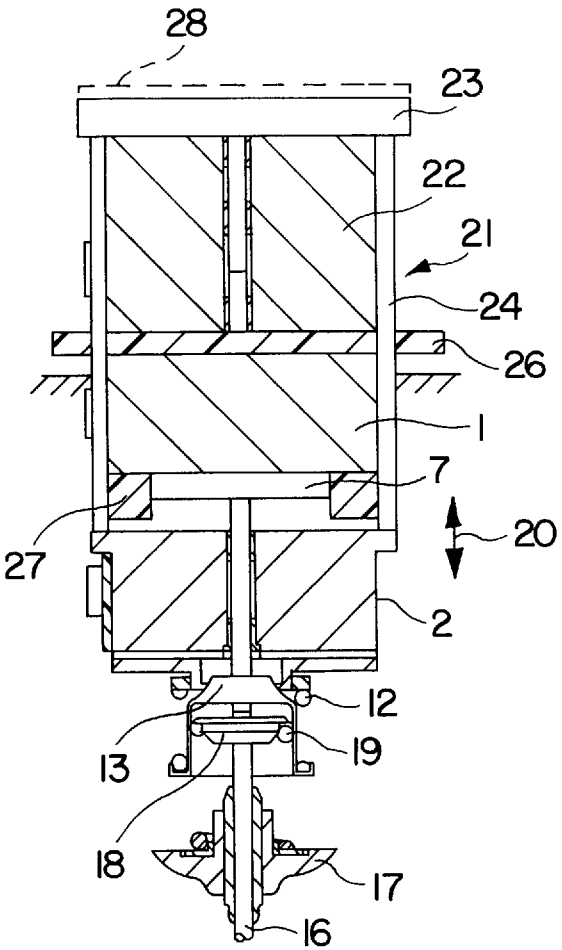
FIG. 3 is an axial sectional view of an actuator with adjustable stroke.

FIG. 3 shows an embodiment of an electromagnetic actuator for operating a cylinder valve which has a spring arrangement as described with the aid of FIG. 2. The arrangement shown in FIG. 3 has an upper electromagnet 1 and a lower electromagnet 2, installed at a distance from each other, between which an armature 7, guided for axial motion, can act upon the valve stem 16 of cylinder valve 15 via its connecting rod 8.

In contrast to the embodiment according to FIG. 1, the electromagnet 2 is positioned such that it can be moved in the direction of the double arrow 20 and is connected to an adjustment device 21 which is essentially composed of an additional magnet 22, an armature plate 23 and a coupling element 24 that is connected to the electromagnet 2 to be moved. The electromagnet 1 and the additional magnet 22 are rigidly connected to the cylinder head 17 by a schematically shown carrier 26.

If power to the additional magnet 22 is cut off, the movably positioned electromagnet 2 is pushed by the spring action of a respective return spring against a spacer 27 which predetermines the clearance between the two pole faces 5 and 6 and thus the possible stroke for armature 7. The armature plate 23 for the adjustment device is at the level of the dashed positioning line 28. The spring elements 12 and 19 at the same time function as return springs.

If electromagnet 22 is energized, the armature plate 23 is attracted and the movably positioned magnet 2 is moved toward the setting element, so that the clearance between the two poles faces 5 and 6 is increased by the predetermined stroke, and the working stroke for armature 7 is increased accordingly. The use of a cylinder valve as the setting element thus makes it possible stroke in a larger valve stroke during the energized state of the additional magnet 22, so that a cylinder valve triggered in this way can be operated with two different stroke amplitudes and thus also with two different opening cross sections.

The "operating direction" of the additional magnet should be selected such that the position of the movable magnet corresponds to the normal operating mode if the additional magnet is without power. If the operating mode with short stroke for armature 7 represents the "normal operating mode," then the armature plate 23 is in the dashed position according to FIG. 3. If the operating mode with long stroke represents the "normal operating mode," then the armature plate 23 must be arranged on the other side of the additional magnet 22. A saving of energy results if the additional magnet is energized only during the respective "special operating phase." In place of a magnetically actuated adjusting device 21, a mechanical, hydraulic or pneumatic adjustment of the stroke amplitude may be provided for armature 7 by moving the magnet 2.

In place of or in combination with the above-described coil springs, it is also possible to use torsion springs or bending springs, for example leaf springs.

The magnets can have a circular, rectangular or square cross section. The latter is advantageous for the laminated yoke element.

It will be understood that the above description of the present invention is susceptible to various modifications, changes and adaptations, and the same are intended to be comprehended within the meaning and range of equivalents of the appended claims.

We claim:

1. An electromagnetic actuator in combination with a cylinder valve of an internal-combustion engine setting member; said actuator comprising (a) a first electromagnet having a first pole face and an end face remote from said first pole face;

(b) a second electromagnet having a second pole face and an end face remote from said second pole face; said second electromagnet being spaced from said first electromagnet, and said first and second pole faces being oriented toward one another;

(c) an armature arranged for reciprocating motion between said pole faces; said armature having a first side oriented toward said first electromagnet and a second, opposite side oriented toward said second electromagnet;

(d) a connecting rod having (1) a first rod part being in an abutting contact with said first side of said armature and being a component separate therefrom; said abutting contact being such as to prevent a torque transmission between said first rod part and said armature;

(2) a second rod part being rigidly affixed to said second side of said armature and extending towards said cylinder valve;

(e) a first spring situated adjacent said end face of said first electromagnet externally therefrom and arranged for urging said first rod part into said abutting contact with said armature for urging said armature away from said first pole face towards said second pole face; and (f) a second spring situated adjacent said end face of said second electromagnet externally therefrom and arranged for urging said armature away from said second pole face towards said first pole face; said first and second springs acting oppositely such that in a de-energized state of said first and second electromagnets said armature being held by said first and second springs in an intermediate position between said first and second pole faces.

2. The electromagnetic actuator as defined in claim 1, further comprising coupling means for preventing torque-transmission between said second rod part and said second spring.

3. The electromagnetic actuator as defined in claim 1, wherein said coupling means comprises (a) a valve stem forming part of said cylinder valve; said valve stem engaging said second rod part in an abutting contact;

(b) a spring seat disk attached to said valve stem and supporting said second spring, whereby said second spring urges said valve stem against said second rod part; said abutting contact between said valve stem and said second rod part being such as to prevent a torque transmission between said valve stem and said second rod part.

4. The electromagnetic actuator as defined in claim 1, further wherein said first and second electromagnets comprise respective magnet coils; further comprising a laminated yoke body; said magnet coils being arranged in said yoke body.

5. An electromagnetic actuator comprising (a) a first electromagnet having a first pole face and an end face remote from said first pole face;

(b) a second electromagnet having a second pole face; said second electromagnet being spaced from said first electromagnet, and said first and second pole faces being oriented toward one another; one of said first and second electromagnets being displaceable relative to the other of said first and second electromagnets for varying a distance between said first and second pole faces;

(c) an armature arranged for reciprocating motion between said pole faces;

(d) a first spring for urging said armature away from said first pole face towards said second pole face;

(e) a second spring for urging said armature away from said second pole face towards said first pole face; said first and second springs acting oppositely such that in a de-energized state of said first and second electromagnets said armature being held by said first and second springs in an intermediate position between said first and second pole faces; and (f) an adjusting device for displacing said one electromagnet into an adjusted position for varying said distance between said first and second pole faces.

6. The electromagnetic actuator as defined in claim 5, further comprising a third electromagnet forming part of said adjusting device for displacing said one electromagnet.

7. An electromagnetic actuator in combination with a setting element; said actuator comprising (a) a first electromagnet having a first pole face;

(b) a second electromagnet having a second pole face and an end face remote from said second pole face; said second electromagnet being spaced from said first electromagnet, and said first and second pole faces being oriented toward one another;

(c) an armature arranged for reciprocating motion between said pole faces; said armature having a first side oriented toward said first electromagnet and a second, opposite side oriented toward said second electromagnet;

(d) a connecting rod attached to said second side of said armature and extending towards said setting element;

(e) a first spring situated adjacent said end face of said second electromagnet externally thereof and acting on said connecting rod for urging said armature towards said second pole face;

(f) a spring support attached to said setting element; and (g) a second spring situated adjacent said end face of said second electromagnet externally thereof and acting on said spring support; said spring support and said connecting rod being force-transmittingly connected for urging said armature towards said first pole face; said first and second springs acting oppositely such that in a de-energized state of said first and second electromagnets said armature is held by said first and second springs in an intermediate position between said first and second pole faces.

* * * * *